United States Patent [19]

Bragg

[11] Patent Number: 4,834,187

[45] Date of Patent: May 30, 1989

[54] EXPLOSION SUPPRESSION SYSTEM

[75] Inventor: Kenneth R. Bragg, Irvine, Calif.

[73] Assignee: Parker Hannifin Corporation, Cleveland, Ohio

[21] Appl. No.: 24,648

[22] Filed: Mar. 11, 1987

[51] Int. Cl.[4] ..... A62C 35/12; A62C 37/14

[52] U.S. Cl. ..... 169/62; 169/28; 169/73; 169/58

[58] Field of Search ..... 169/28, 58, 56, 60, 169/62, 61, 73, 72, 71, 54, 84, 85, 89, 33, 66, 37; 222/95, 105, 389, 394, 638; 239/553, 553.5, 555

[56] References Cited

U.S. PATENT DOCUMENTS

| | | | |
|---|---|---|---|
| 2,149,446 | 3/1939 | Kunz | 169/28 X |
| 2,557,162 | 6/1951 | Wetzel et al. | 169/73 |
| 2,719,589 | 10/1955 | Mapes | 169/28 X |
| 2,736,386 | 2/1956 | Klompar | 169/28 X |
| 2,808,114 | 10/1957 | Parker, Jr. | 169/28 X |
| 2,867,282 | 1/1959 | Bagno et al. | 169/66 X |
| 3,613,794 | 10/1971 | Naumann | 169/28 |
| 3,773,111 | 11/1973 | Dunn | 169/56 X |
| 3,888,313 | 6/1975 | Freeman | 169/37 X |
| 4,319,640 | 3/1982 | Brobeil | 169/28 |
| 4,700,894 | 10/1987 | Grzych | 239/555 |
| 4,760,886 | 8/1988 | Sassier | 169/28 |

FOREIGN PATENT DOCUMENTS

| | | | |
|---|---|---|---|
| 139509 | 3/1953 | Sweden | 169/28 |
| 576117 | 10/1977 | U.S.S.R. | 169/28 |
| 677754 | 8/1979 | U.S.S.R. | 169/28 |
| 1235506 | 6/1986 | U.S.S.R. | 169/28 |
| 1319864 | 6/1987 | U.S.S.R. | 169/60 |

*Primary Examiner*—Sherman D. Basinger
*Assistant Examiner*—James M. Kannofsky
*Attorney, Agent, or Firm*—Christopher H. Morgan

[57] ABSTRACT

An explosion suppression system wherein a photodetector (10), a capacitor circuit (12) and a detonator (14) provide an initiation signal to a dispersion tube (18). The dispersion tube includes a casing (20) having orifices (26), an inner tube (28) where the explosion suppressant is stored, and a propellant cord (34) that is located between the storage casing and the inner tube. In response to the initiation signal, the explosion suppressant is expelled from the orifices (26) and through nozzles (27) to form a controlled spray pattern to quench initial flame in a fuel tank before there is time for a damaging pressure rise.

9 Claims, 3 Drawing Sheets

EXPLOSION SUPPRESSION SYSTEM

BACKGROUND OF THE INVENTION

1. Field of the Invention

The subject invention concerns fire extinguishing systems and, more particularly, explosion protection systems for use in applications such as aircraft fuel tanks.

2. Description of the Prior Art

In the prior art, both suppression and inserting systems have been developed to provide protection against explosions. Explosion suppression systems are intended to extinguish a combustion condition before uncontrolled combustion achieves unacceptable levels. For example, in a fuel tank an explosion suppression system is intended to extinguish a combustion condition before the pressure rise in the tank causes the tank to explode.

Explosion suppression accepts that a fire already exists with a flame front moving through the vessel. Behind the flame front, heat of combustion is released and local temperatures and pressures are high. The suppressant must absorb sufficient combustion energy to lower temperatures and pressures and to quench the fire. Ahead of the flame front, flame propagation must be arrested to stop the release of additional energy.

Unlike suppression systems, inerting systems are designed to provide a nonexplosive environment in the area of concern. Thus, even in the presence of an ignition source, no explosion will occur because combustion cannot be sustained. For example, in fuel tanks inerting systems typically supplant oxygen in the tank ullage with nitrogen, helium, carbon dioxide, or other inert gas. This condition is maintained for as long as protection is desired by adjusting for expansion of the tank ullage and for variations in external pressure.

Early inerting systems had several disadvantages and deficiencies. For example, some fuel tank inerting systems required that dissolved oxygen be purged from the fuel before it was placed in the tank. Another common disadvantage was that sufficient quantities of the inerting gas were not always conveniently available. To address the problem of dissolved oxygen in the fuel, some subsequent inerting systems used halon as an inerting gas. These systems were an improvement in that they would tolerate the presence of oxygen but they did not overcome the problem of a convenient source of inerting gas.

To overcome the difficulty of inert gas availability, still other inerting systems employed inert gas generation equipment. Typically, these systems used nitrogen as an inerting gas with the generation equipment stripping oxygen from air to provide a nitrogen supply. The disadvantage with these systems was that they tended to be mechanically complicated and, therefore, costly to construct, operate and maintain. Also, these systems produced a limited flow of inert gas that, in many cases, was inadequate to meet peak demands, such as large variants in ullage volume or pressure. Thus, inert gas storage tanks were generally required for these systems, adding significantly to system size and weight. For some applications such as aircraft fuel tanks, such limitations seriously compromised the availability and operational performance of the vehicle.

Despite performance and cost penalties of inerting systems, the prior explosion protection relied on inerting systems because there was no practical alternative. Prior art suppressant systems proposed vacuum tubes and other sensors to detect combustion conditions. These sensors were connected to various suppressant storage devices containing freon, carbon tetrachloride, halon or other inert gas. The storage device released the suppressant through explosive impulse or other mechanism in response to a signal from the sensor. Such prior art systems were generally found to be too slow or too unreliable for arresting an explosion after combustion had begun. Other explosion protection systems, such as reticulated foam systems, were too heavy or otherwise unsuitable for many applications.

Nevertheless, a practical explosion suppression system would offer significant advantages over inerting systems. Since suppression systems are mechanically simpler, they would tend to be more reliable than inerting systems. Such simplicity would also tend to make the cost of constructing, installing and maintaining a suppression system substantially lower than corresponding costs for an inerting system. Moreover, the cost and maintenance associated with obtaining and handling consumables used in inerting systems would be eliminated. Other advantages of such mechanical simplicity and the avoidance of consumables include a higher degree of availability and a reduction in system weight. Moreover a suppression system would be installed on existing vehicles more easily than an inerting system. Accordingly, there was a need in the prior art for an effective explosion suppression system that was reliable, but compact and required limited, if any, maintenance.

SUMMARY OF THE INVENTION

In accordance with the subject invention, an explosion suppression system includes a light sensor and a detonator that provides an initiation signal in response to an output from the light sensor. A dispersion vessel that is connected to the detonator sprays a fire suppressant in response to the initiation signal.

Preferably, the dispersion vessel includes a storage casing that has at least one linear array of orifices that are located longitudinally along said storage casing. Inside the storage casing, an inner membrane is provided for storing the suppressant material. The inner membrane has a free wall area that is spaced apart from the inside of the storage casing and cooperates with the storage casing to define a propellant chamber. A propellant cord is located in the propellant chamber and is connected to the detonator. The propellant cord is responsive to an initiation signal from the detonator to apply pressure against and collapse the inner membrane to expel the suppressant through the storage casing orifices.

More preferably, the explosion suppression system includes a nozzle that has a body with an inner opening, a plurality of circumferential slits that are located adjacent the outer circumference of the body, and radial paths that extend between the circumferential slits and the inner opening. The dispersion vessel is located in the inner opening of the body and cooperates with the body to define an annular nozzle cavity. End plates are located at opposite ends of the body and cooperate with the body and the dispersion vessel to define end walls of the annular nozzle cavity. Suppressant that is expelled through the orifices of the storage casing passes through the nozzle cavity, the radial paths, and the circumferential slits to form a spray pattern.

Most preferably, the body of the nozzle is comprised of a plurality of orifice plates with each plate defining an inner aperture. Each of said plates has a face with a circumferential flow channel located adjacent the outer perimeter of the plate and a plurality of radial flow channels that extend between the circumferential flow channel and the inner aperture. Each of the plates cooperates with an adjacent plate to form the circumferential slits and radial flow paths in the body. It is also preferred that the nozzle include a deflector member that has a body and radial fingers that extend from the body such that the fingers cooperate with the circumferential slits to direct the spray pattern of the nozzle.

Other details, objects and advantages of the subject invention will become apparent as the following description of a presently preferred embodiment proceeds.

BRIEF DESCRIPTION OF THE DRAWINGS

The accompanying drawings show a presently preferred embodiment of the invention in which.

DESCRIPTION OF THE PREFERRED EMBODIMENT

Figure 1:
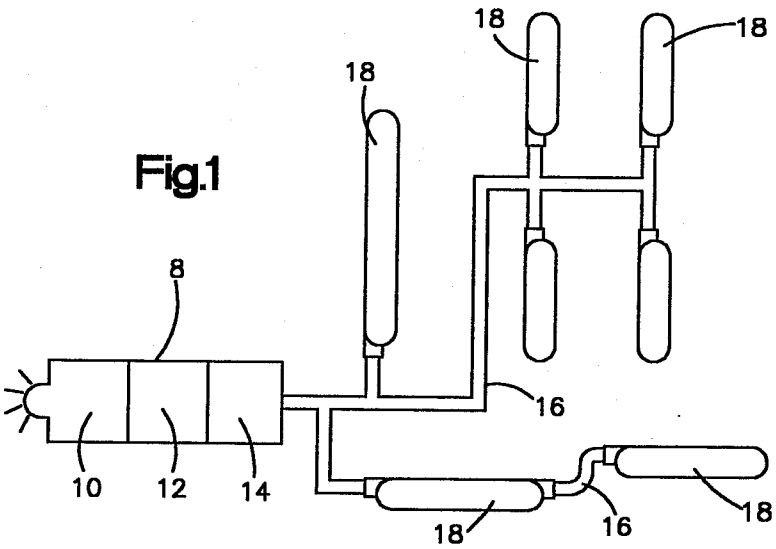
FIG. 1 is a schematic diagram of the explosion suppression system herein disclosed.
Figure 2:
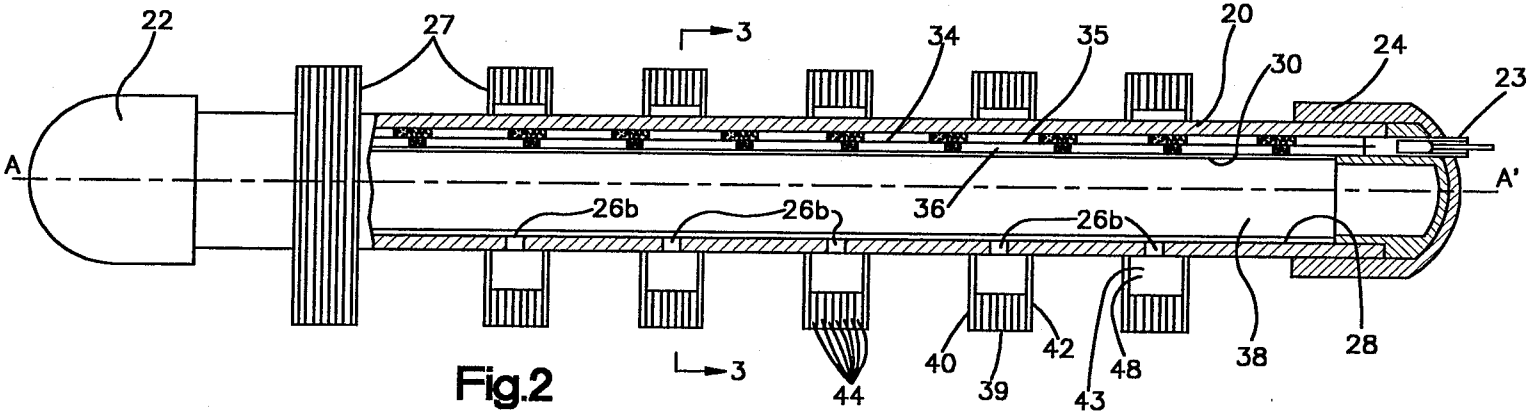
FIG. 2 is a longitudinal cross-section of the dispersion tube shown schematically in FIG. 1.
Figure 7:
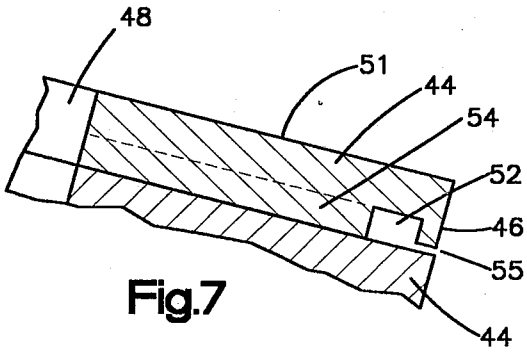
FIG. 7 is a radial cross-section of a portion of the dispersion tube of FIG. 3 taken along the lines VII—VII.
Figure 6:
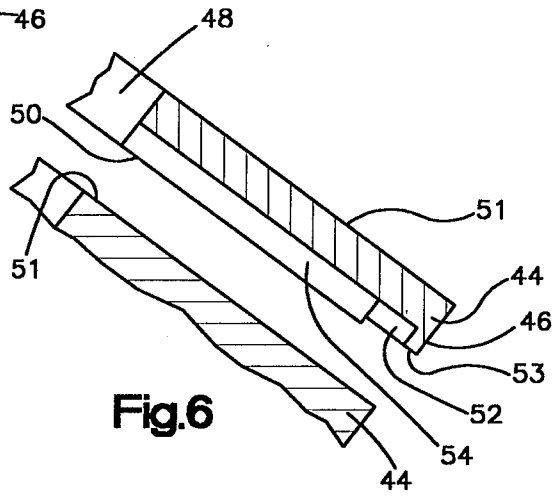
FIG. 6 is an exploded radial cross-section of a portion of the dispersion tube of FIG. 3 taken along the lines VI—VI.

FIG. 1 shows a schematic diagram of the explosion suppression system disclosed herein. In FIG. 1, an explosion sensor assembly 8 includes a light sensing means such as a photodetector 10 connected to a capacitor discharge circuit 12 and an exploding bridgewire detonator 14. In some cases, optical fibers can be used in combination with photodetector 10 to monitor portions of the fuel tank visually obstructed from the sensor. Preferably, photodetector 10 is optically filtered to have a pass-band in the infrared region. This makes photodetector 10 insensitive to electrostatic discharge arcs that are not reliable indicators of an explosion. Discharge circuit 12 includes a high voltage—high current capacitor, signal conditioners, power supplies and control circuits in accordance with conventional circuit design.

Discharge circuit 12 is electrically connected to exploding bridgewire 14. When photo detector 10 senses a source of light, it provides an electrical signal to capacitor circuit 12 which in turn discharges a high energy electric pulse into detonator 14. The duration and intensity of the pulse is such that detonation is initiated in a small secondary explosive charge within detonator 14. This produces a detonation shock wave which exits detonator 14 at an outlet port in sensor 8 and serves as the discharge signal to actuate the system.

The outlet port of sensor 8 is mechanically connected to one or more dispersion tubes in the fuel tank by signal transmission cords 16. The detonation shock wave produced by detonator 14 is transferred through cords 16 to each of the dispersion tubes to initiate dispersion of suppression as hereafter more fully explained with regard to FIGS. 2–5. Dispersion tubes 18 may be connected to sensor 8 in parallel and/or in series according to the requirements of the application. When connected in series, the detonation shock wave is transmitted by a cord 16 to one end of a dispersion tube 18, through the length of that tube by its propellant cord fuse 35, out into another cord 16 and on to another dispersion tube 18. For this application the cord 16 may be flexible to improve installation access.

Referring to FIGS. 2–5, each dispersion tube 18 includes a casing 20 that is provided with end caps 22 and 24. One or both end caps include a detonation shock wave transfer fitting 23 through which detonation shock waves can enter casing 20 and also exit the casing at the opposite end when desirable. Preferably, casing 20 has a substantially circular cross-section and is provided with at least one linear array of orifices 26 located longitudinally along the casing. It is preferred that casing 20 be made of high-strength steel such as maraging steel. When used in an aircraft fuel tank suppression system, the dispersion tubes 18 are located in the fuel tank so as to distribute stored suppressant throughout the tank, including extremities, in the least amount of time. Thus, each of the dispersion tubes 18 is spaced apart from the others in an array inside the fuel tank.

In the dispersion tube 18 shown in FIGS. 2–5, casing 20 has three linear arrays of orifices **26*a*, 26*b* and 26*c* that are arranged substantially parallel to longitudinal axis A—A'. The orifice arrays 26*a*, 26*b* and 26*c* are angularly located in casing 20 such that they are positioned in the casing opposite the propellant cord 34. Linear arrays 26*a* and 26*c* are angularly positioned at approximately 60° from and on opposite sides of linear array 26*b*. Other angular arrangements might be most suitable for equal distribution over an asymmetrical space. As more specifically described herein, a nozzle 27 is associated with each radial set of orifices 26*a*, 26*b* and 26*c*** at a given longitudinal location.

Dispersion tube 18 further includes an inner tube or membrane 28 that is located in the inner area of casing 20. Inner tube 28 generally follows and is generally supported by the inner surface of casing 20. However, inner tube 28 includes a free wall area 30 that is spaced apart from the inner surface of storage casing 20 and cooperates with the inner surface of storage casing 20 to define a propellant chamber 32. A propellant cord 34 is maintained in propellant chamber 32. Propellant cord 34 is connected to detonatings cord 16 by way of transfer fitting 23 that extends through end cap 24.

Figure 3:
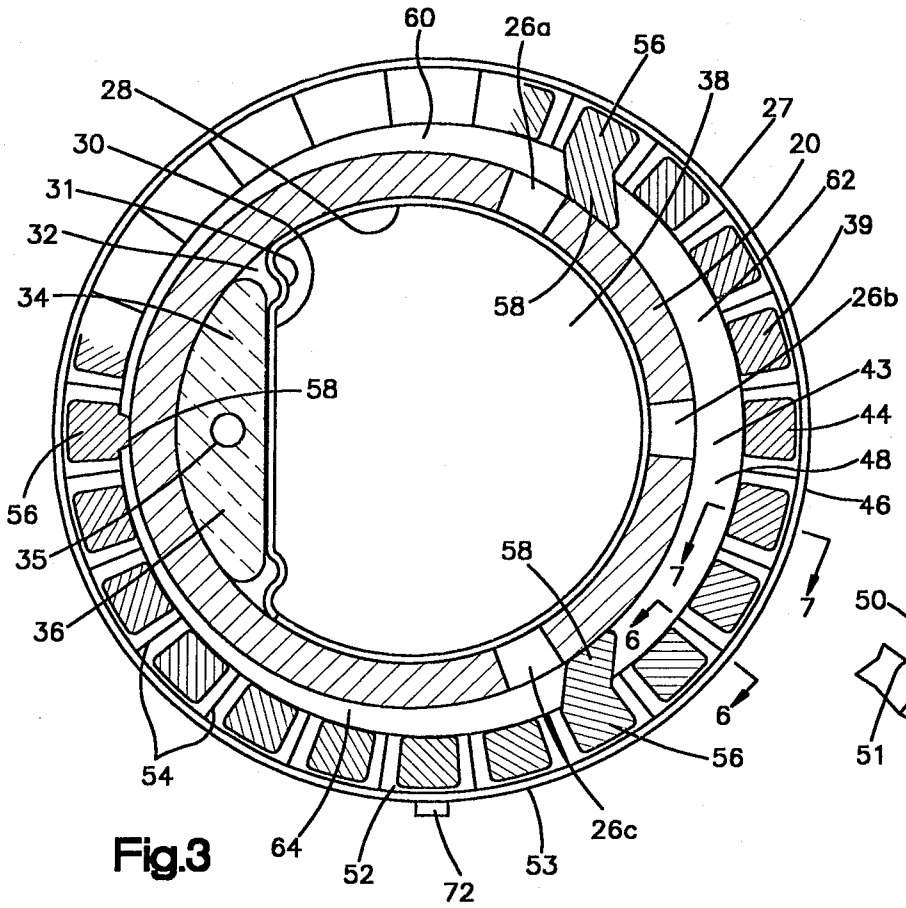
FIG. 3 is a radial cross-section of the dispersion tube of FIG. 2 taken along the lines III—III and showing the tube in its inactive state.

In the storage mode of dispersion tube 18, FIG. 3, inner tube 28 covers orifices 26 in storage casing 20 and acts as a retaining membrane to contain a fire suppressant 38. Preferably, the suppressant is water. Water provides the highest heat absorption capacity per unit volume as compared to other flame suppressants. It has both the highest heat of vaporization and the highest specific heat. High heat absorption capacity minimizes the quantity of suppressant required to quench a flame to the point where it cannot propagate. It has been shown that ½ cubic inch of water, uniformly dispersed, will quench the flame of one cubic foot of hydrocarbon combustible mixture. Therefore, a relatively small tube and a relatively small amount of water contained therein will satisfactorily suppress an explosive fire in a large aircraft fuel tank. Also preferably, in applications where vessel temperatures below 32° are anticipated, the suppressant includes a freezing temperature depressant such as calcium chloride or other water soluble salt. The freezing temperature depressant lowers the freezing point of the suppressant, making the system operable over a broader range of temperatures.

Preferably, inner tube 28 is made of thin-walled tubing of malleable, corrosion-resistant metal to limit diffusion of the suppressant through the inner tube 28 walls and to accommodate the deflections which occur during suppressant discharge. A preferred inner tube material is Inco Alloy C-276 with a wall thickness of 0.004 inch. The wall area 30 is provided with axial convolutions 31 to provide sufficient cross section elasticity.

Propellant cord 34 includes a secondary explosive fuse 35 in combination with a chemical propellant 36 such as smokeless powder. Fuse 35 is a length of standard mild detonating cord consisting of an aluminum tube in the order of 0.050 inch diameter containing 2.5 grains per foot of a secondary explosive such as RDX. When explosive fuse 35 is impacted by a detonation shock wave from detonating cord 16, propellant cord 34 ignites and burns the propellant. Secondary explosive fuse 35 has a relatively fast reaction velocity, in the order of 27000 feet per second, as compared to chemical propellant 36 to rapidly spread combustion within propellant cord 34. Chemical propellant 36 has relatively slower combustion velocity in the order of inches per second to extend the period during which propellant cord 34 continues to generate gaseous products of combustion.

Figure 4:
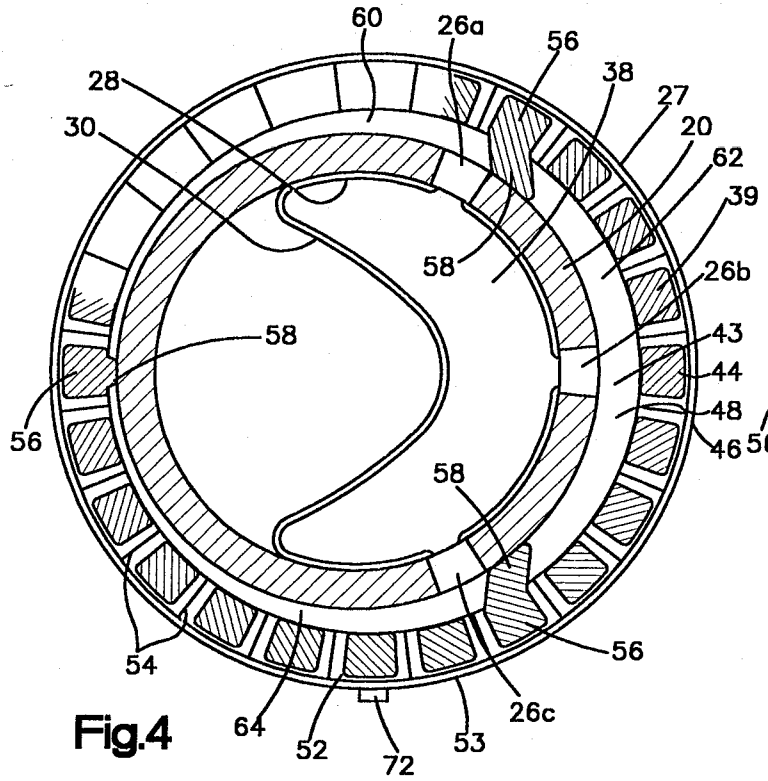
FIG. 4 is a radial cross-section of the dispersion tube of FIG. 3 showing the tube as suppressant is being expelled.

The combustion gases develop pressure against free wall area 30 of inner tube 28. This elevates the pressure in inner tube 28 until the areas of the inner tube exposed to orifice 26 rupture as shown in FIG. 4. When this happens, suppressant 36 is rapidly expelled through orifices 26 and nozzles 27 and sprayed into the ullage of the fuel tank.

Figure 5:
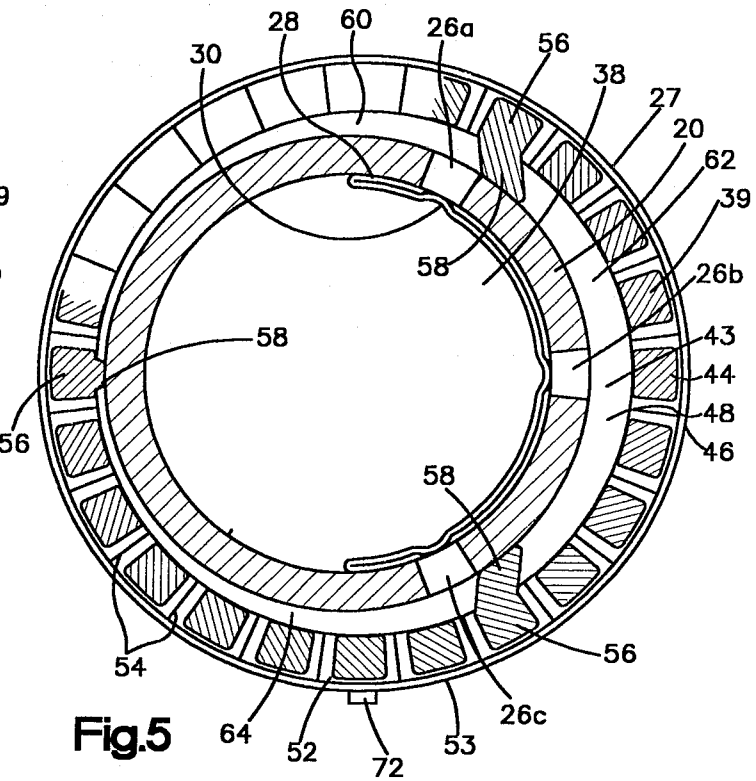
FIG. 5 is a radial cross-section of the dispersion tube of FIG. 3 showing the tube after suppressant has been expelled from the tube.

As shown in FIG. 5, when suppressant 38 has been completely expelled from inner membrane 28, the free wall area 30 of inner membrane 28 has been collapsed onto the remainder of inner membrane 28 such that the free wall area covers orifices 26*a*, 26*b* and 26*c*. It is preferred that free wall area 30 include a fiber-reinforced material or fabric so that the portions of the free wall area exposed to orifices 26 do not rupture.

In order to suppress the explosion, the suppressant must lower the heat of combustion to sufficiently quench the fire and must also inert the uncombusted liquid. Accordingly, the diameter of dispersion tube 18 is selected so that a unit length of dispersion tube contains a sufficient quantity of suppressant to quench and inert the corresponding volume of the tank. In addition, the number, direction and cross-sectional area of orifices 26 is selected so that dispersion tube 18 will rapidly and effectively disperse the suppressant so that it remains suspended for a sufficient time to inert the uncombusted fluid until the fire has been quenched at the point of combustion.

In certain applications, orifices 26 can be selected and designed with respect to the shape of the vessel to provide appropriate angular and axial distribution of the suppressant from the orifices. Furthermore, it has been found that the range of the suppressant from the orifices is limited by entrainment of ullage gases. Thus, the range of the suppressant can also be controlled in accordance with the design of orifices 26 such that the jets reach remote portions of the vessel.

As shown in FIGS. 2–7, nozzle 27 includes a body 39 and end plates 40 and 42. Body 39 cooperates with storage casing 20 to define an annular nozzle cavity 43 between nozzle 27 and dispersion tube 18. Shown in cross-section in FIGS. 3, 4 and 5, body 39 includes a plurality of orifice plates 44. Each orifice plate 44 has an outer perimeter 46 and an inner aperture 48 that are formed between oppositely disposed parallel face and back surfaces 50 and 51 respectively shown in FIGS. 6 and 7. Peripheral channel 52 is cut into face surface 50 separated from outer perimeter 46 by peripheral rim 53. A plurality of radial channels 54 are cut into surface 50 to extend between inner aperture 48 to peripheral channel 52. Back surface 51 is smooth without channels. Peripheral channel 52 and radial channels 54 are relatively deep below surface 50, for example, 0.008 inch. Rim 53 surface is relatively shallow below surface 50, for example, 0.0002 inch. The plurality of orifice plates 44 are arranged in face to back relationship such that rim 53 of one orifice plate 44 cooperates with the back of an adjacent plate 44 to form a continuous circumferential slit 55, for example, 0.0002 inch wide. A plurality of such cooperating plates provide any desired number of parallel extremely narrow slits. Similarly peripheral channel 52 and radial channels 54 of one orifice plate cooperate with the back of an adjacent plate to form radial flow paths and a peripheral flow path between inner aperture 48 and each of the circumferential slit 55.

The arrangement of nozzle 27 can be modified to control the performance parameters of the spray. The distance of the surface of rim 53 below surface 50 determines the width of circumferential slit 55 which determines the drop size. It has been shown that as a sheet of liquid flows out of a narrow slit, surface tension breaks the sheet into droplets with a diameter twice the width of the slit. With a slit width of 0.0002 inch which is five microns the droplet size will be in the order of 10 microns. Drop size affects the time to accomplish quenching because as drop size decreases the surface area of the suppressant increases and the heat transfer rate therefore increases. It has been shown that 10 micron drops of water will vaporize completely in less than one millisecond.

The number of adjacent slits in a nozzle determines the reach of the suppressant streams. When there is a single slit the sheet of droplets injected into the ullage is closely surrounded by gas. The jet of droplets entrains the surrounding gas and is stopped with a short reach. When there are a number of adjacent slits the ullage gas is entrained by the external streams of droplets and the internal streams are unobstructed and produce longer reach.

The orifice plates 44 of body 39 further include projections 56 that extend in a generally radial direction into inner aperture 48 of the orifice plates. Projections 56 have terminal ends 58 that define arcs on a circle that is of substantially the same diameter as the outer circumference of storage casing 20. Thus, projections 56 of plates 44 are combined in body 39 to separate annular nozzle cavity 43 into three isolated segments 60, 62 and 64. Projections 56 are spaced at regular angular intervals so that segments 60, 62 and 64 are regularly angularly spaced. Projections 56 are located such that orifices 26*a*, 26*b* and 26*c* are in communication with segments 60, 62 and 64 respectively.

As shown in FIGS. 3–5, terminal ends 58 define arcs on a circle that is eccentric with respect to the outer circumference of plates 44 and body 39. The angular position of projections 56 with respect to the eccentricity of the circle defined by ends 58 is such that cavity segment 62 is symmetrical and cavity segments 60 and 64 are asymmetrical. More specifically, cavity segments 60 and 64 have a continuously decreasing radial dimension at increasing angular positions from cavity segment 62. Furthermore, cavity segment 62 is also tapered toward a smaller radial dimension in an angular direction away from the bisector of symmetrical segment 62. Segments 60, 62 and 64 cause the spray pattern of nozzle 27 to be directed 360° completely around dispersion tube 18.

As also shown in FIGS. 3–5, orifice plates 44 include at least one projection 72 that extends radially from the peripheral surface 46. Projection 72 extends at a known angular location on the eccentric circle defined by projections 56 so that it indicates the angular orientation of nozzle 27 with respect to dispersion tube 18. Thus, projection 72 provides an indication of the spray pattern direction.

While a presently preferred embodiment of the invention is shown and described herein, the subject invention is not limited thereto but may be otherwise variously embodied within the scope of the following claims.

I claim:

1. A spray nozzle for use in an explosion suppression system wherein an explosion suppressant is stored in a dispersion tube, said nozzle comprising:

a plurality of orifice plates, each of said plates having an outer perimeter and defining an inner aperture, one face of each of said plates having a circumferential flow channel that is located adjacent the outer perimeter and a plurality of radial flow channels that extend between said circumferential flow channel and the inner aperture, said plurality of orifice plates being arranged together in face-to-face relationship such that the circumferential flow channel and the radial flow channels of one orifice plate cooperate with an adjacent orifice plate to define a circumferential slit and radial flow paths respectively, said orifice plates cooperating with the dispersion tube to define an annular nozzle cavity; and at least two end plates that are located on opposite ends of the orifice plate arrangement, said end plates defining an inner opening that has a shape that substantially corresponds to the cross-sectional shape of the dispersion tube.

2. The spray nozzle of claim 1 wherein the dispersion tube has a substantially circular cross-section and the inner opening of said end plates is also substantially circular with substantially the same diameter as the storage tube, said orifice plates further including:

projections that extend radially into the inner aperture of said orifice plates, said projections having terminal ends that define arcs on a circle that is of substantially the same diameter as the outer perimeter of said storage tube.

3. The spray nozzle of claim 2 wherein each of said orifice plates includes three projections that are equally angularly spaced around the inner aperture of said orifice plate.

4. The spray nozzle of claim 2 wherein the terminal ends of said projections define arcs on a circle that is eccentric with respect to the outer perimeter of said orifice plates.

5. The spray nozzle of claim 4 wherein said orifice plates includes at least one projection that extends radially from the outer perimeter of said orifice plates, said projection being arranged to indicate the angular orientation of said orifice plate with respect to the storage tube.

6. The spray nozzle of claim 4 wherein the projections of said plurality of orifice plates cooperate with the dispersion tube to define a passage having one symmetrical segment and two asymmetrical segments.

7. The spray nozzle of claim 6 wherein the asymmetrical segments are tapered toward a smaller radial dimension in an angular direction away from the symmetrical segment.

8. The spray nozzle of claim 6 wherein the symmetrical and asymmetrical segments are tapered toward a smaller radial dimension at angular direction away from the bisector of the symmetrical segment.

9. A spray nozzle for use in an explosion suppression system wherein an explosion suppressant is stored in a dispersion tube, said nozzle comprising:

a generally cylindrical body having an inner opening that has a cross-sectional area that is larger than the cross-sectional area of said dispersion tube, the dispersion tube being located in the inner opening such that the body cooperates with the dispersion tube to define an annular nozzle cavity, said body having a plurality of circumferential slits located adjacent the outer circumference and a plurality of radial flow paths that extend between the circumferential slits and the inner opening; and at least two end plates that are located at opposite ends of said body, said end plates defining an inner opening that has a shape that substantially corresponds to the cross-sectional shape of the dispersion tube.

* * * * *